US006022241A

United States Patent [19]

Lin

[11] Patent Number: 6,022,241

[45] Date of Patent: Feb. 8, 2000

[54] DECORATION LAMP DEVICE

[76] Inventor: Mei-Lu Lin, No. 56, Min Sheng Street, Feng-Yuan City 420, Taiwan

[21] Appl. No.: 09/166,208

[22] Filed: Oct. 2, 1998

[51] Int. Cl.[7] ..... H01R 4/24; H01R 33/00; H01J 9/03

[52] U.S. Cl. ..... 439/419; 439/619; 362/226; 362/257

[58] Field of Search ..... 439/419, 619, 439/699.2; 362/226, 257, 249

[56] References Cited

U.S. PATENT DOCUMENTS

| | | | |
|---|---|---|---|
| 5,418,698 | 5/1995 | Wu | 362/252 |
| 5,562,481 | 10/1996 | Myson | 439/419 |
| 5,672,077 | 9/1997 | Wang et al. | 439/619 |

*Primary Examiner*—Cassandra Spyrou
*Assistant Examiner*—Fayez Assaf

[57] ABSTRACT

A decoration lamp device has a lamp holder, an inner socket receiving the lamp holder, an outer socket union device receiving the inner socket, a bulb having a base portion and a lower post, the lamp holder having an outer housing receiving the base portion of the bulb and an inner housing receiving the lower post of the bulb, a base plug disposed on a bottom of the inner socket, and an outer casing having a neck portion and a head portion. The outer socket union device has a first half outer socket and a second half outer socket. The first half outer socket has a first semicircular positioning groove and the second half outer socket has a second semicircular positioning groove to receive the neck portion of the outer casing.

2 Claims, 5 Drawing Sheets

DECORATION LAMP DEVICE

BACKGROUND OF THE INVENTION

This invention relates to a decoration lamp device, and more particularly, this invention relates to a decoration lamp device which contains an outer socket and an inner socket to position an outer casing stably.

A conventional decoration lamp device comprises a lamp holder, a socket receiving the lamp holder, and a bulb dispopsed on the lamp holder. However, the leakage of water and electricity is often occured.

Another conventional decoration lamp device comprises a lamp holder, a socket receiving the lamp holder, a bulb dispopsed on the lamp holder, and an outer casing covering the bulb. However, it is difficult to assemble the outer casing. Furthermore, the lamp holder is easily loosened. Therefore, the electric communication of the conventional decoration lamp device will be poor.

SUMMARY OF THE INVENTION

An object of the invention is to provide a lamp device which contains an outer socket to position an outer casing stably.

DETAILED DESCRIPTION OF THE INVENTION

Figure 1:
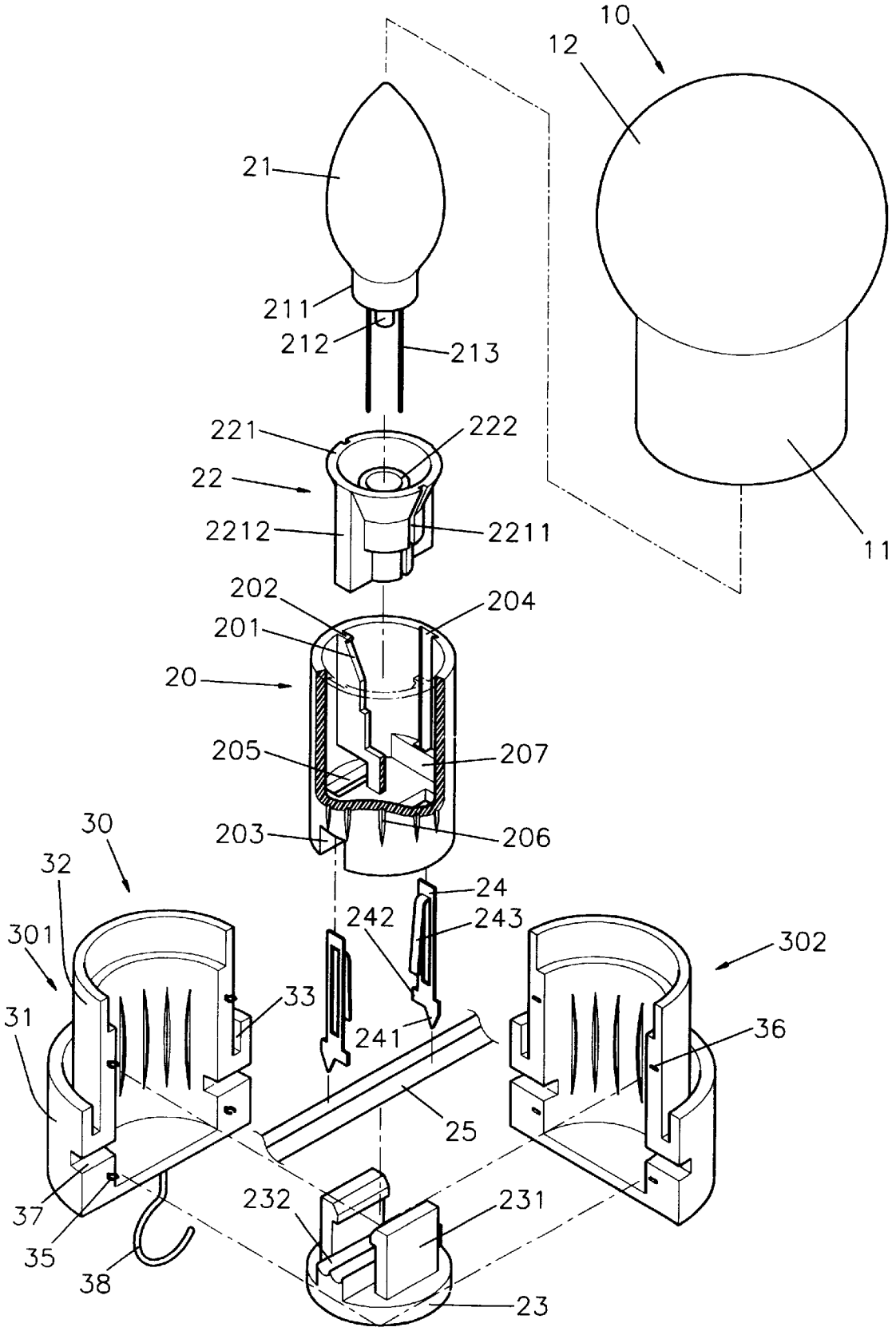
FIG. 1 is a perspective exploded view of a decoration lamp device of a preferred embodiment in accordance with this invention.
Figure 2:
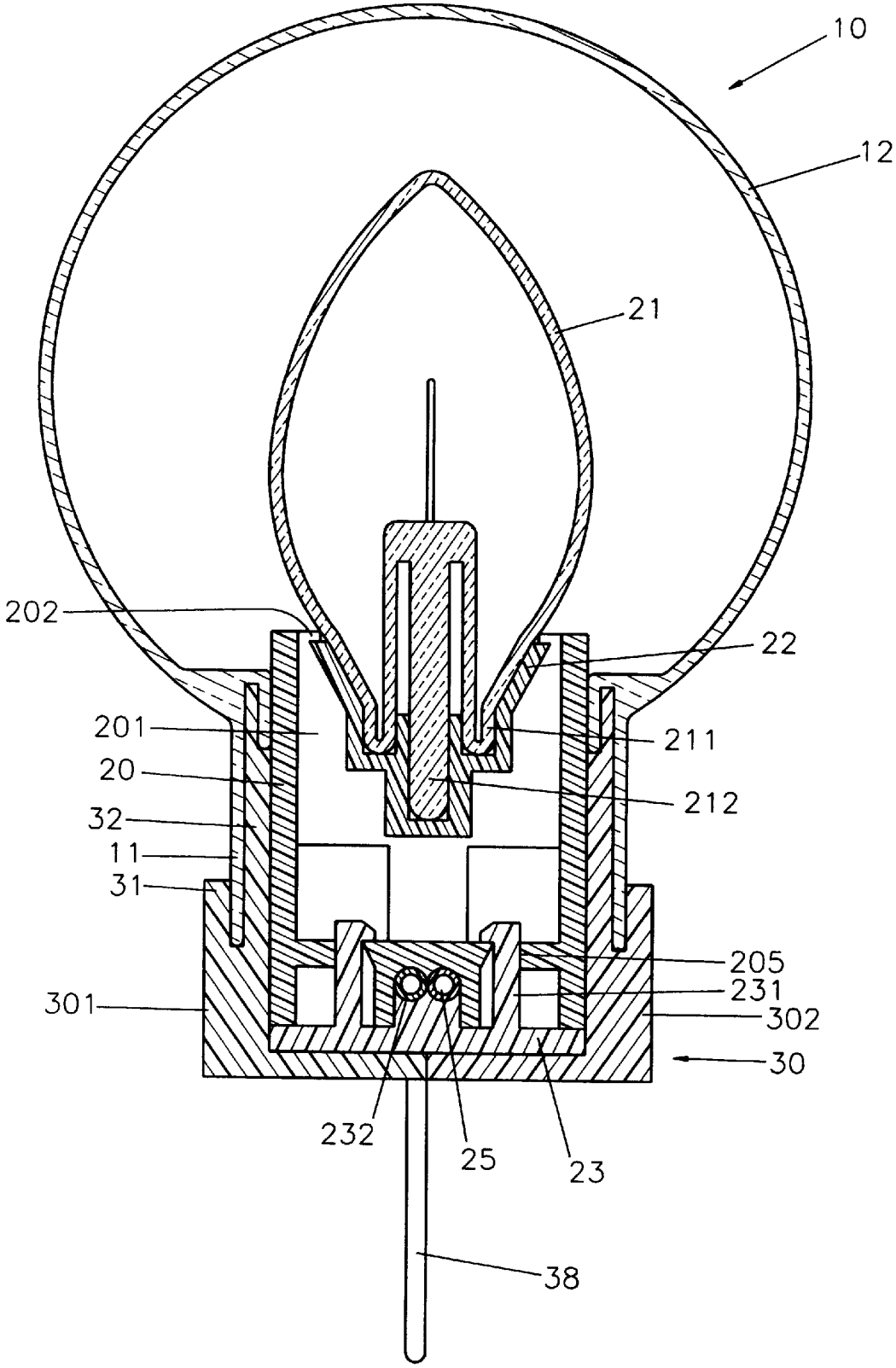
FIG. 2 is a sectional assembly view of a decoration lamp device of a preferred embodiment in accordance with this invention.
Figure 3:
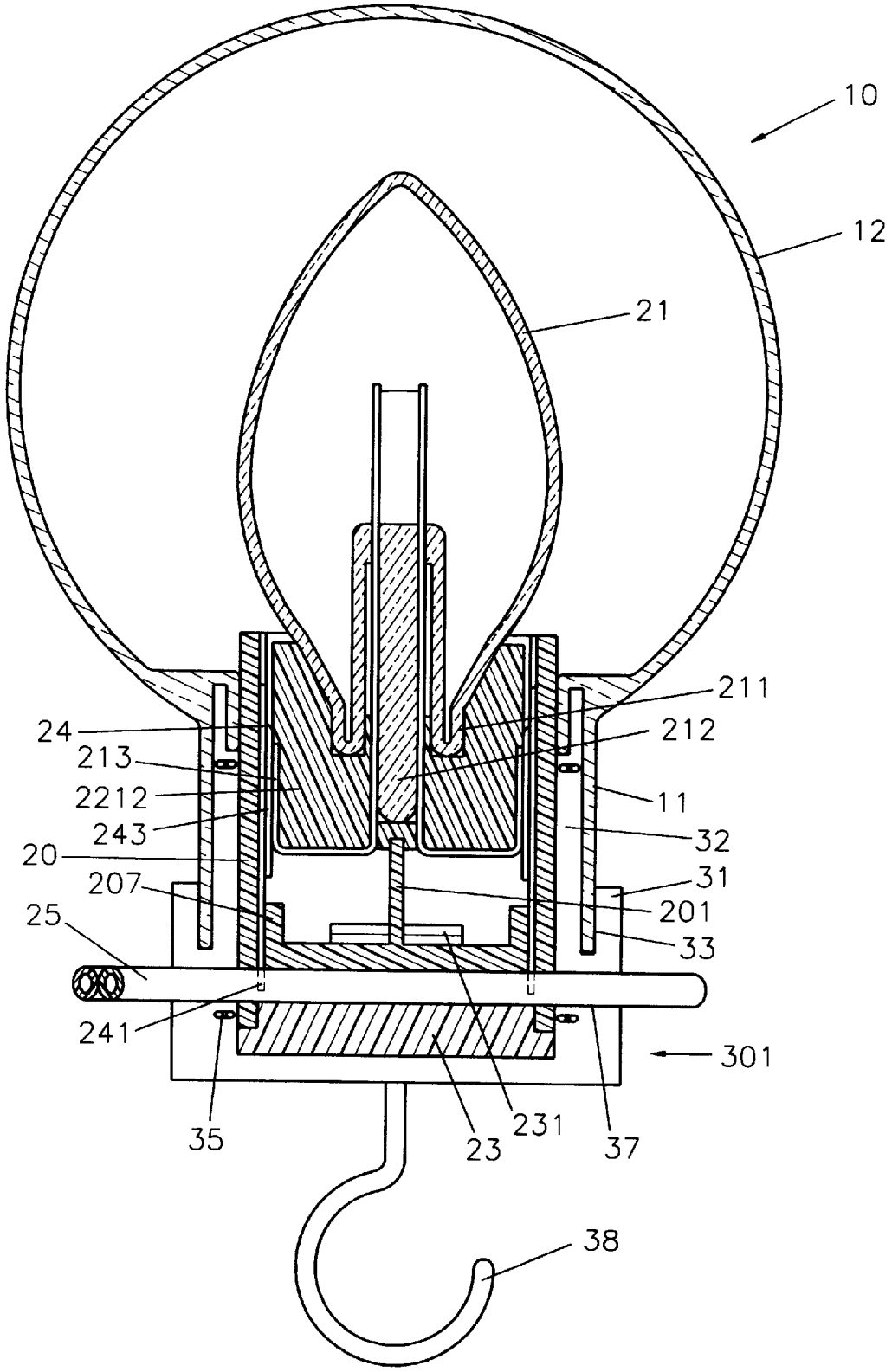
FIG. 3 is another sectional assembly view of a decoration lamp device of a preferred embodiment in accordance with this invention.
Figure 4:
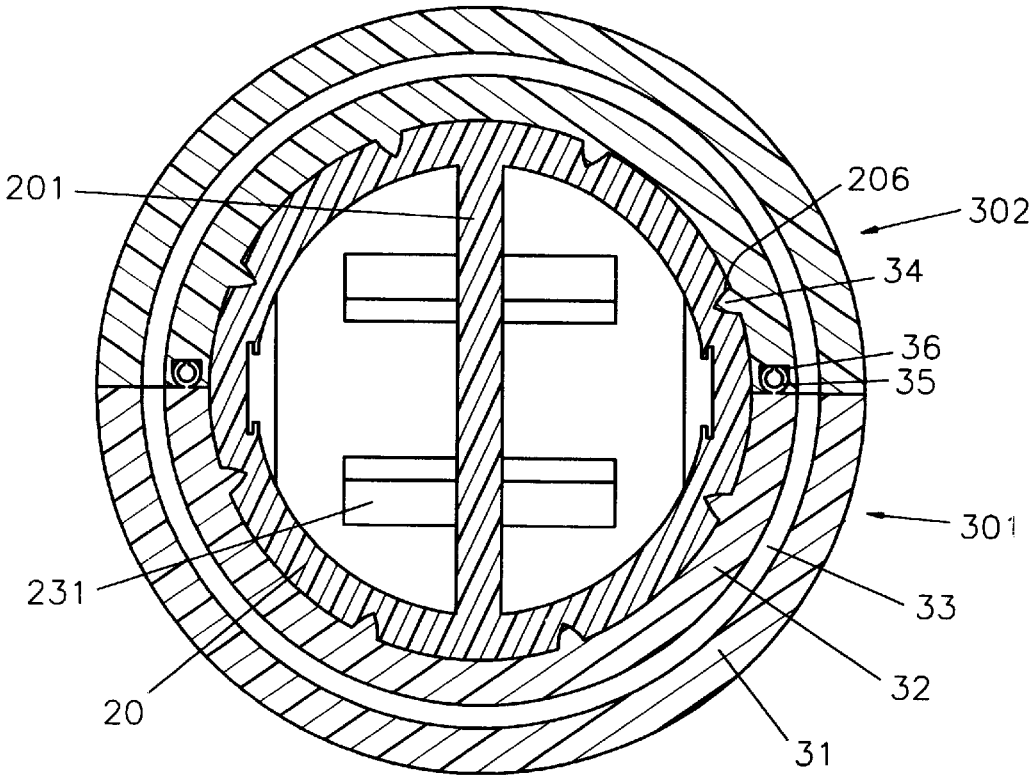
FIG. 4 is a horizontal sectional view of a decoration lamp device of a preferred embodiment in accordance with this invention.
Figure 5:
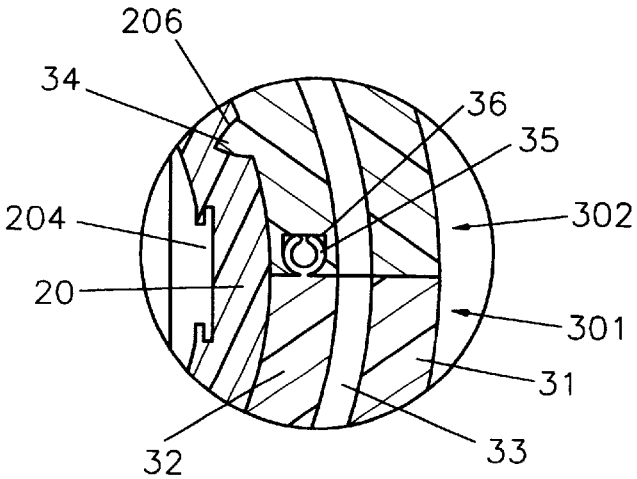
FIG. 5 is another horizontal sectional view of a decoration lamp device illustrating an engagement of a C-shaped insertion rod and a C-shaped hole.
Figure 6:
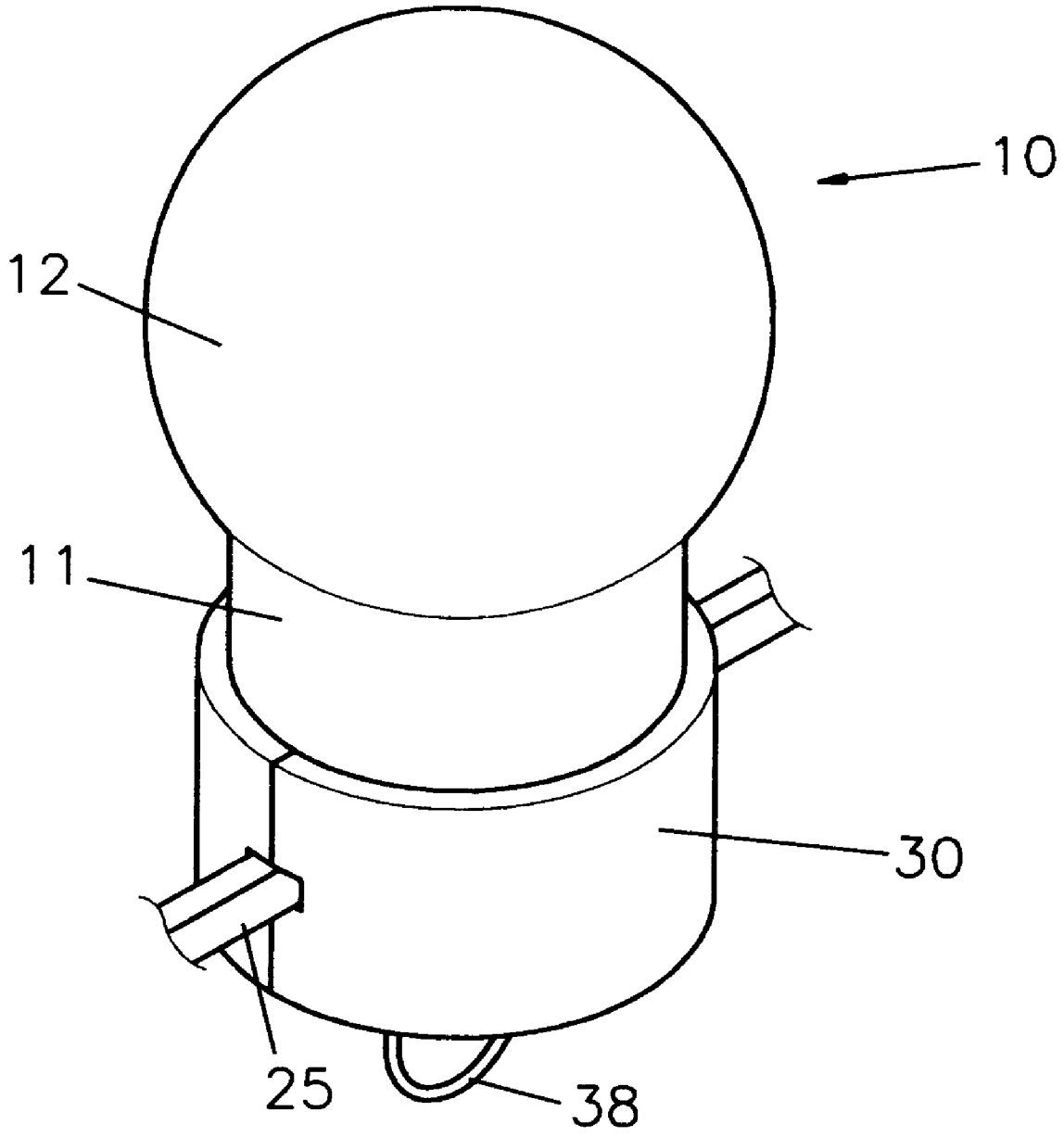
FIG. 6 is a perspective assembly view of a decoration lamp device of a preferred embodiment in accordance with this invention.

Referring to FIGS. 1 to 6, a decoration lamp device comprises a lamp holder 22, an inner socket 20 receiving the lamp holder 22, an outer socket union device 30 receiving the inner socket 20, a bulb 21 having a base portion 211 and a lower post 212, two lead-in wires 213 extending outward from an interior of the bulb 21, the lamp holder 22 having an outer housing 221 receiving the base portion 211 of the bulb 21 and an inner housing 222 receiving the lower post 212 of the bulb 21, a base plug 23 disposed on a bottom of the inner socket 20, and an outer casing 10 having a neck portion 11 and a head portion 12. The outer housing 221 flares upward.

The inner socket 20 has two step-shaped plates 201, two guide grooves 204, a plurality of arc grooves 206, two bottom insertion holes 205, a bottom notch 203, and two blocking bars 207. Each of the step-shaped plates 201 has a distal positioning hook 202. Two conductive plates 24 are inserted in the guide grooves 204. Each of the conductive plates 24 has a tip end 241, a block plate 242, and an elastic plate 243. The block plate 242 is blocked by the respective blocking bar 207. The elastic plate 243 contacts the respective lead-in wire 213.

The base plug 23 has two insertion plates 231 and two linear recesses 232. Each of the insertion plates 231 is inserted in the respective bottom insertion hole 205.

The lamp holder 22 further has two positioning recesses 2211 and two protruded plates 2212. Each of the step-shaped plates 201 is inserted in the respective positioning recess 2211. Each of the lead-in wires 213 passes through the inner housing 222 and bends on the respective protruded plate 2212.

The outer socket union device 30 has a first half outer socket 301 and a second half outer socket 302. The first half outer socket 301 has a lower hook 38, a first outer wall 31, a first inner wall 32, a first semicircular positioning groove 33, a plurality of first arc plates 34, two linear grooves 37, and a plurality of C-shaped insertion rods 35. The height of the first inner wall 32 is higher than the height of the first outer wall 31. The second half outer socket 302 has a second outer wall 31', a second inner wall 32', a second semicircular positioning groove 33', a plurality of second arc plates 34', two linear recesses 37', and a plurality of C-shaped grooves 36. The height of the second inner wall 32' is higher than the height of the second outer wall 31'. The C-shaped insertion rods 35 are inserted in the C-shaped grooves 36.

The first arc plates 34 and the second arc plates 34' are inserted in the arc grooves 206. The first semicircular positioning groove 33 and the second semicircular positioning groove 33' receive the neck portion 11 of the outer casing 10.

Referring to FIGS. 1 to 5 again, the bulb 21 is inserted in the lamp holder 22. The lower post 212 and the lead-in wires 213 are inserted in the inner housing 222. The base portion 211 is inserted in the outer housing 221. The lamp holder 22 is inserted in the inner socket 20. Each of the step-shaped plates 201 is inserted in the respective positioning recess 2211. The conductive plates 24 are inserted in the guide grooves 204. The elastic plate 243 contacts the respective lead-in wire 213. Each of the lead-in wire 213 is confined by the respective distal positioning hook 202. Two wires 25 are disposed on the linear recesses 232. Each of the insertion plates 231 is inserted in the respective bottom insertion hole 205. Each of the tip ends 241 penetrates the respective wire 25. The first half outer socket 301 and the second half outer socket 302 enclose the inner socket 20. The C-shaped insertion rods 35 are inserted in the C-shaped grooves 36. The first arc plates 34 and the second arc plates 34' are inserted in the arc grooves 206. The first semicircular positioning groove 33 and the second semicircular positioning groove 33' receive the neck portion 11 of the outer casing 10.

The outer socket union device 30 and the outer casing 10 can prevent water from entering the decoration lamp device. The lamp holder 22 and the inner socket 20 are positioned in the decoration lamp device stably.

I claim:

1. A decoration lamp device comprising:

a lamp holder, an inner socket receiving the lamp holder, an outer socket union device receiving the inner socket, a bulb having a base portion and a lower post, two lead-in wires extending outward from an interior of the bulb, the lamp holder having an outer housing receiving the base portion of the bulb and an inner housing receiving the lower post of the bulb, a base plug disposed on a bottom of the inner socket, and an outer casing having a neck portion and a head portion, the outer housing flaring upward, the inner socket having two step-shaped plates, two guide grooves, a plurality of arc grooves, two bottom insertion holes, a bottom notch, and two blocking bars, each of the step-shaped plates having a distal positioning hook, two conductive plates inserted in the guide grooves, each of the conductive plates having a tip end, a block plate, and an elastic plate, the block plate blocked by the respective blocking bar, the elastic plate contacting the respective lead-in wire, the base plug having two insertion plates and two linear recesses, each of the insertion plates inserted in the respective bottom insertion hole, the lamp holder having two positioning recesses and two protruded plates, each of the step-shaped plates inserted in the respective positioning recess, each of the lead-in wires passing through the inner housing and bending on the respective protruded plate, the outer socket union device having a first half outer socket and a second half outer socket, the first half outer socket having a first outer wall, a first inner wall, a first semicircular positioning groove, a plurality of first arc plates, two linear grooves, and a plurality of C-shaped insertion rods, the height of the first inner wall higher than the height of the first outer wall, the second half outer socket having a second outer wall, a second inner wall, a second semicircular positioning groove, a plurality of second arc plates, two linear recesses, and a plurality of C-shaped grooves, the C-shaped insertion rods inserted in the C-shaped grooves, the height of the second inner wall higher than the height of the second outer wall, the first arc plates and the second arc plates inserted in the arc grooves, the first semicircular positioning groove and the second semicircular positioning groove receiving the neck portion of the outer casing.

2. A decoration lamp device as claimed in claim 1, wherein the first half outer socket has a lower hook.

* * * * *